United States Patent [19]

Bentley

[11] 4,273,139

[45] Jun. 16, 1981

[54] FIRMNESS IMPROVEMENT IN CIGARETTE ROD

[75] Inventor: George W. Bentley, Clarksville, Ind.

[73] Assignee: Brown & Williamson Tobacco Corporation, Louisville, Ky.

[21] Appl. No.: 105,812

[22] Filed: Dec. 20, 1979

[51] Int. Cl.[3] ..... A24C 5/04; A24C 5/60

[52] U.S. Cl. ..... 131/280; 131/84 A

[58] Field of Search ..... 131/20 R, 21 R, 21 B, 131/23 R, 29, 31, 62, 120, 121, 133 R, 133 A, 140 R, 140 A, 140 B; 73/37–37.8, 38

[56] References Cited

U.S. PATENT DOCUMENTS 3,633,590 1/1972 Pocock et al. ..... 131/21 B X

*Primary Examiner*—V. Millin

*Attorney, Agent, or Firm*—Charles G. Lamb; William J. Mason

[57] ABSTRACT

An apparatus and method for improving the firmness of cigarettes utilizing high energy gas waves for reorienting tobacco in a cigarette rod during manufacture. The apparatus includes a housing having means therein directing a cigarette rod therethrough and an opening therein in flow communication with high energy gas means.

7 Claims, 1 Drawing Figure

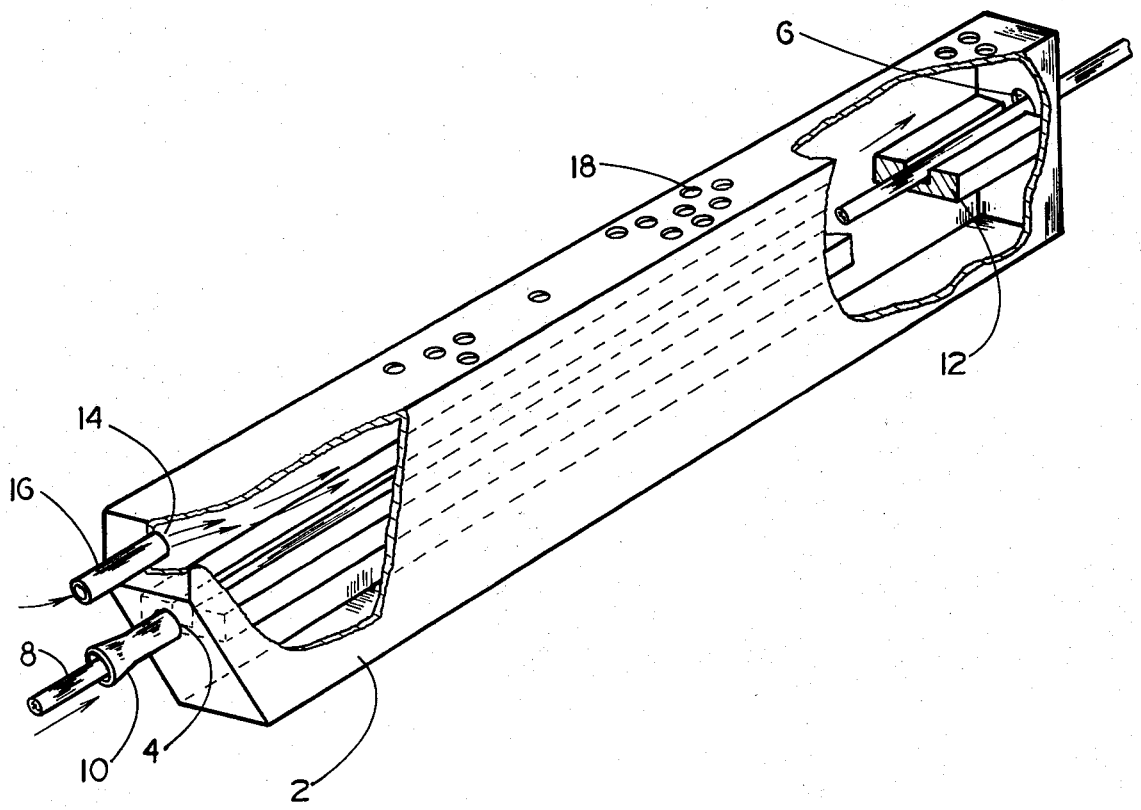
6
18
12
14
16
8
10
4
2

FIRMNESS IMPROVEMENT IN CIGARETTE ROD

BACKGROUND OF THE INVENTION

This invention relates to the manufacture of cigarette rods and more particularly relates to an apparatus and method for improving the firmness of a cigarette during the manufacture thereof.

In the manufacture of cigarette rods, complex machinery is necessary as the manufacturing occurs at high speed. In the filling or wrapping step, tobacco is fed into a wrapper at relatively high speeds forming a cigarette rod which is subsequently cut, also at high speed, into preselected sizes. In this processing or manufacturing stage, there is generally a tendency for the tobacco strands to become axially aligned within the cigarette rod. Because of this alignment, low void volumes occur and the firmness of the cigarette product is relatively low. Also, the final product, the tobacco, not being perfectly aligned, has an uneven density or fill value of tobacco within the cigarettes and voids are found therein.

SUMMARY OF THE INVENTION

In the present invention, it is recognized that it is desirable to provide an apparatus for improving the firmness of a cigarette rod during manufacture. Furthermore, it is also recognized that it is desirable to provide a method for improving the firmness of a cigarette rod during manufacture.

The present invention advantageously provides a straightforward arrangement for an apparatus for improving the firmness of a cigarette rod using high energy gas waves during the manufacture thereof. The present invention further provides a method for improving the firmness of a cigarette rod during manufacture utilizing high energy gas.

Various other features of the present invention will become obvious to those skilled in the art upon reading the disclosure set forth hereinafter.

More particularly, the present invention provides an apparatus for improving the firmness of a cigarette rod comprising: a housing having spaced aligned inlet and outlet openings to receive a cigarette rod therethrough; guide means between the inlet and outlet openings to guide the cigarette rod through the housing; and, a gas opening in the housing in flow communication with a gas supply source.

Even more particularly, the present invention provides a method for improving the firmness of cigarettes comprising the steps of: passing a cigarette rod through a firmness treating zone; and, treating the cigarette rod in the zone with high energy gas.

It is to be understood that the description of the example of the present invention given hereinafter is not by way of limitation and various modifications within the scope of the present invention will occur to those skilled in the art upon reading the disclosure set forth hereinafter.

BRIEF DESCRIPTION OF THE DRAWING

Referring to the drawing:

The FIGURE is a perspective view, with selected portions cutaway, of one preferred apparatus for improving the firmness of a cigarette rod.

DESCRIPTION OF THE PREFERRED EMBODIMENT OF THE INVENTION

In the FIGURE, the housing 2 for receiving a formed cigarette rod therethrough is provided with a cigarette rod inlet 4 and a cigarette rod outlet 6, inlet 4 and outlet 6 being in spaced alignment. The housing 2 is disposed between a garniture and a cutter of a cigarette making machine (not shown).

An outwardly extending guide member 10 having a centrally disposed opening therethrough is attached to the housing 2 circumscribing and in axial alignment with the inlet 4. The outwardly extending guide member 10 receives the cigarette rod 8 therethrough guiding the rod into the housing 2. Disposed within the housing 2 is an interior guide member 12 of channel-shaped cross-section wherein the channel of the guide member 12 is in alignment with the opening in the exterior guide member 10 for receiving the cigarette rod 8 therethrough.

The housing 2 is also provided with a gas inlet opening 14 which includes a conduit member 16 in flow communication with a gas supply source (not shown) for delivering gas, usually air, at a preselected velocity. As exemplified, the velocity is determined by a $\frac{1}{8}$-inch diameter inlet at between 5 and 40 psig. It is realized that, for other inlet opening sizes the pressure of the gas can be altered accordingly to maintain sufficient energy for disorienting tobacco strands. For example, for larger inlet openings, the gas pressure can be less and converse for smaller inlet openings.

A plurality of substantially small apertures 18 are provided in the housing 2 to vent or allow the escape of gas from the housing 2. However, even though it is preferred to have small apertures 18 therein, it is realized that these apertures are not necessary.

In the operation of the apparatus for improving the firmness of cigarettes, a cigarette rod 8 passes through the unit at relatively high speed, generally between 200 and 1500 feet per minute, and gas is introduced through conduit 16 at 5 psig to 40 psig at a $\frac{1}{8}$-inch diameter inlet opening. This is sufficient to set up vibrations within the rod, thereby reorienting the previously aligned tobacco. The firmness of the final product, a cigarette, is thereby improved.

Also, in a preferred embodiment, the housing is generally about 1.5 inches by 1.75 inches by 36 inches, and is inserted between the garniture and cutting head of a cigarette maker. This allows sufficient dwell-time immediately after rod formation, during the tobacco relaxation period, to reorient the previously aligned tobacco particles.

It will be realized that various changes may be made to the specific embodiment shown and described without departing from the principle and scope of the present invention.

What is claimed is:

1. An apparatus for improving the firmness of cigarette rods comprising:

a housing having spaced aligned inlet and outlet openings to receive a cigarette rod therethrough;

guide means between said inlet and outlet openings to guide a cigarette rod through said housing; and, a gas supply opening in the housing in flow communication with a gas supply source and means for maintaining at least 5 psig gas pressure in said housing while said cigarette is travelling through said housing at a predetermined velocity so as to reorient said tobacco particles.

2. The apparatus of claim 1 including a plurality of gas escape apertures in said housing to vent gas from the apparatus.

3. The apparatus of claim 1 wherein said guide means includes an exterior outwardly extending guide member with a centrally disposed opening therethrough in alignment with said inlet opening, and an interior guide member of channel-shaped cross section, said channel being in alignment with said outwardly extending guide member.

4. The apparatus of claim 1 wherein said gas is air.

5. A method for improving the firmness of cigarettes comprising the steps of:

passing cigarette rod through a firmness treating zone; and, treating the cigarette in said zone with a gas having a fluid pressure of at least 5 psig so as to reorient said tobacco particles within said rod while said cigarette is passing through said firmness treating zone at a predetermined velocity.

6. The method of claim 5 wherein the cigarette rod is traveling at a rate of 200 to 1500 feet per minute.

7. The method of claim 5 wherein the gas pressure is from about 5 to 40 psig with an inlet opening for the gas supply to the treating zone being about ⅛-inch in diameter.

* * * * *